US005713756A

United States Patent [19]

Abe

[11] Patent Number: 5,713,756

[45] Date of Patent: Feb. 3, 1998

[54] INSULATION DISPLACEMENT CONNECTOR

[75] Inventor: Kimihiro Abe, Shizuoka, Japan

[73] Assignee: Yazaki Corporation, Tokyo, Japan

[21] Appl. No.: 698,927

[22] Filed: Aug. 16, 1996

[30] Foreign Application Priority Data

Sep. 11, 1995 [JP] Japan ..... 7-232693

[51] Int. Cl.[6] ..... H01R 4/24

[52] U.S. Cl. ..... 439/404

[58] Field of Search ..... 439/404, 399, 439/400, 405, 417

[56] References Cited

U.S. PATENT DOCUMENTS

| | | | |
|---|---|---|---|
| 4,062,616 | 12/1977 | Shaffer et al. | 439/404 |
| 5,041,009 | 8/1991 | McCleerey | 439/405 |
| 5,376,018 | 12/1994 | Davis et al. | 439/404 |
| 5,415,562 | 5/1995 | Matsumoto et al. | 439/399 |
| 5,536,182 | 7/1996 | Atoh et al. | 439/404 |

FOREIGN PATENT DOCUMENTS 61-8952 1/1986 Japan .

*Primary Examiner*—Gary F. Paumen
*Assistant Examiner*—Tho Dac Ta
*Attorney, Agent, or Firm*—Morgan, Lewis & Bockius LLP

[57] ABSTRACT

In the insulation displacement connector, there are provided: a housing; terminal receiving chambers formed in the housing; an opening portion formed in the housing so as to expose the terminal receiving chambers to the outside; and an openable/closable cover having a pair of supporting arms which are projected from opposite ends of the openable/closable cover and which are pivotally supported at their top ends on the housing so that when the cover is rotated toward the housing the opening portion is closed by the cover, while in an opened state a feed through space feedable in the front and rear directions of the housing is formed between the pair of supporting arms.

18 Claims, 5 Drawing Sheets

INSULATION DISPLACEMENT CONNECTOR

BACKGROUND OF THE INVENTION

1. Field of the Invention

The present invention relates to an insulation displacement connector in which a coated electric wire is pressed as it is into press-fitting blades so that the coating is cut open and conductors of the electric wire and the press-fitting blades are made to be electrically conductive with each other.

2. Description the Prior Art

In an insulation displacement connector, a coated electric wire is pressed into slit-like press-fitting blades of a press-fitting terminal so that the coating of the electric wire is cut open by the blades to make the conductors of the electric wire electrically conductive with the press-fitting blades to thereby electrically connect the electric wire to the press-fitting terminal. This press-fitting connector, has to a disadvantage of weak electric wire holding strength in the press-fitting connecting portion, although it has an advantage in that it is suitable for mass production because of its simple structure, since electric conduction can be carried out only by pressing a coated-electric wire into the blades. An example of such an insulation displacement connector of this kind having a so-called strain relief structure in which an electric wire bent portion is provided so as to increase the electric wire holding strength, Japanese Utility Model Publication No. Sho. 61-8952 which will be described with reference to FIGS. 4 to 6. FIG. 4 is a sectional view showing the conventional press-fitting connector in a state before press-fitting connection of an electric wire; FIG. 5 is a perspective view showing a press-fitting terminal used in the conventional press-fitting connector; arid FIG. 6 is a sectional view showing the conventional press-fitting connector in a state after press-fitting connection of the electric wire.

FIG. 4 shows a terminal receiving chamber 3 is formed in a housing 1 so as to be opened in the front and rear of the housing 1. A first electric wire holding portion 7 is continuously formed so as to extend from a rear end of the upper surface of the housing 1 through a hinge portion 5, and a second electric wire holding portion 11 is continuously formed so as to extend from a rear end of the lower surface of the housing 1 through a hinge portion 9. A press-fitting terminal 13 shown in FIG. 5 is provided in the terminal receiving chamber 3. Slit-like press-fitting blades 17 into which an electric wire 15 is to be pressed are formed on the press-fitting terminal 13. The electric wire 15 is pressed into the press-fitting blades 17 so that insulation coating of the wire is cut open to make conductors 15a be electrically conductive with the press-fitting blades 17.

The insulation displacement connector 19 is assembled in a manner so that, as shown in FIG. 4, the press-fitting terminal 13 is inserted from the rear side of the terminal receiving chamber 3 and the electric wire 15 is disposed above the press-fitting blades 17. Next, the first and second electric wire holding portions 7 and 11 are rotated through the hinge portions 5 and 9 respectively in the direction to approach and joined with each other as shown in FIG. 6. At that time, a pressing portion 21 (FIG. 4) projected from the first electric wire holding portion 7 presses the electric wire 15 into the press-fitting blades 17. At the same time, the electric wire 15 is grasped and held in a bent state at a bent portion 27 between convex and concave portions 23*b* and 23*a* which are formed to face each other in the first and second electric wire holding portions 7 and 11 respectively.

In this state, the first and second electric wire holding portions 7 and 11 are locked with each other by means of locking portions 25*b* and 25*a* so that they cannot be separated freely from each other.

In such an insulation displacement connector 19, the electric wire 15 is grasped in a bent state between the first and second electric wire holding portions 7 and 11 projected from the rear portion of the housing 1, so that the tensile strength can be ensured by the bent portion 27 to thereby make it possible to protect the press-fitting connection portion from external tensile force.

Further, there has been proposed another press-fitting connector in which a press-fitting connection portion is protected from external tensile force without providing the foregoing first and second electric wire holding portions 7 and 11. For example, as shown in FIG. 7, in the insulation displacement connector of this kind, pressing portions 33 are formed on the rear portions of press-fitting blades 31 of a press-fitting terminal 29 so that the electric wire 15 is caulked by the pressing portions 33 at the same time when the electric wire 15 is pressed into the press-fitting blades 31 to absorb external tensile force to thereby protect the press-fitting connection portion from external tensile force.

The foregoing press-fitting connector shown in FIG. 6, exhibits a problem that the first and second electric wire holding portions 7 and 11 for grasping an electric wire to extend from the rear portion of the housing 1, thereby the length of the insulation displacement connector 19 is increased by the length L (in FIG. 6) of the first and second electric wire holding portions 7 and 11. On the other hand the press-fitting connector in which the pressing portions 33 are formed on the press-fitting connection portion 29 so as to hold the electric wire is, taking the place of the first and second electric wire-holding portions 7 and 11, which also has the problem that the pressing portions 33 are required to be disposed at the rear ends of the press-fitting blades 31 and therefore the press-fitting terminal 29 is increased by the length a, of the pressing portions 33 thereby increasing the length of the insulation displacement connector.

SUMMARY OF THE INVENTION

In view of the foregoing circumstances, an object of the present invention is to provide an insulation displacement connector in which a high electric wire holding force can be obtained without providing any special electric wire holding structure or any terminal pressing portion, to reduce the cost and size insulation displacement connector.

According to the present invention, there is provided an insulation displacement connector comprising: a housing having a terminal receiving chamber and an opening portion formed so as to expose the terminal receiving chambers to the outside; and a cover pivotably supported on the housing so that when the cover is rotated toward the housing, the opening portion is closed by the cover, while in an opened state a feed through space feedable in the front and rear directions of the housing is formed in the cover.

In the above configuration, the cover may have a pair of supporting arms which are projected from opposite ends thereof and pivotably supported at top ends thereof on the housing while in an opened state a feed through space feedable in the front and rear direction of the housing is formed between the pair of supporting arms.

In the thus configured press-fitting connector, the openable/closable cover is opened so as to form a feed through space feedable in the front and rear direction of the housing between the supporting arms. An electric wire is inserted from the front side of the housing, and a top end of tile electric wire inserted through the feed through space is pressed into the press-fitting contact portion. When the electric wire portion positioned in the front side of the housing is folded to the rear side of the housing along the connector bend support surface after the opening portion of the housing is closed by the openable/closable cover, a contact portion of the electric wire contacting with the openable/closable cover is U-like bent so that external tensile force acting on the base end portion of the electric wire can be absorbed by this bent portion.

DETAILED DESCRIPTION OF THE PREFERRED EMBODIMENT

A preferred embodiment of the insulation displacement connector according to the present invention will be described in detail below with reference to the accompanying drawings.

Figure 1:
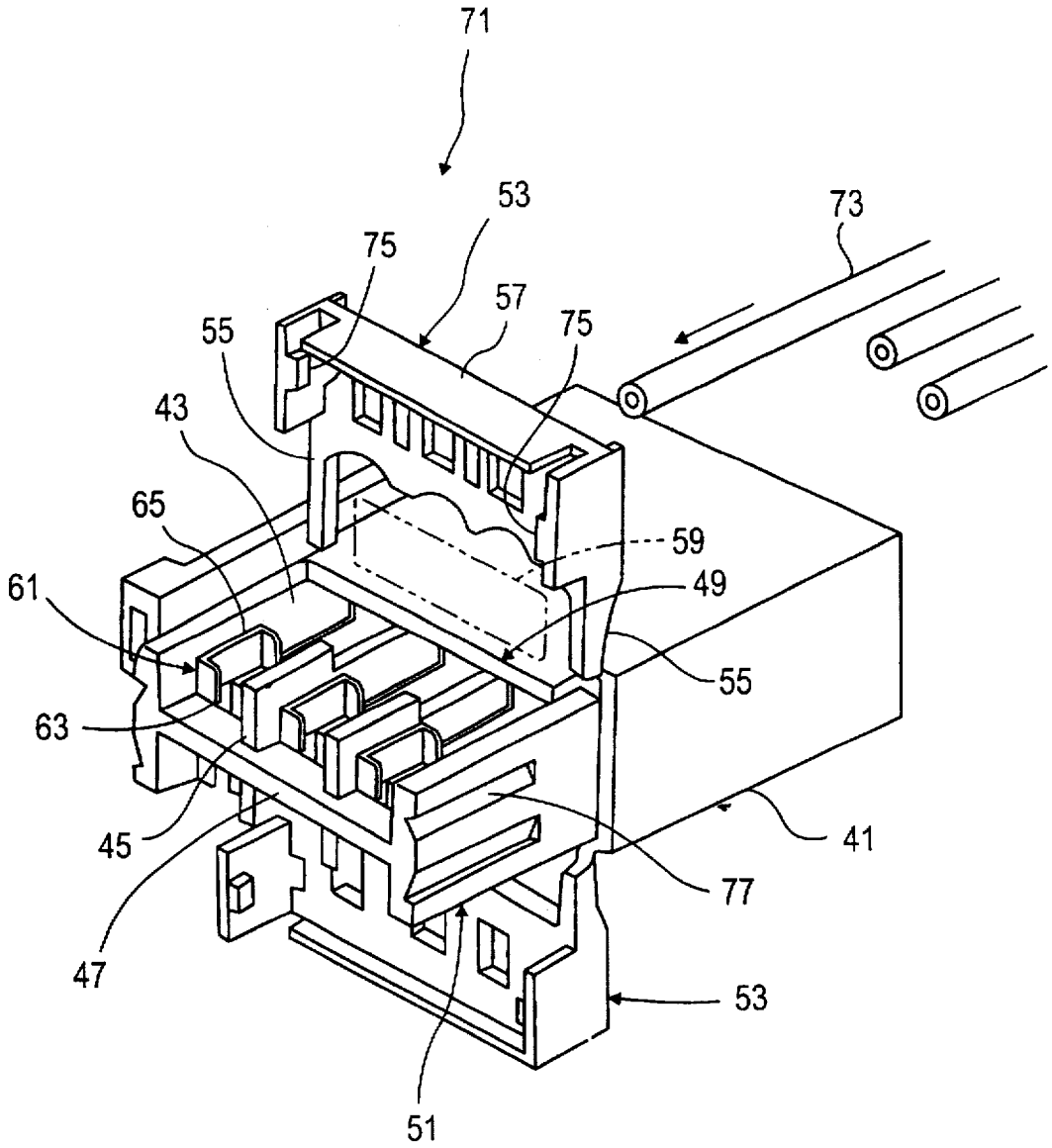
FIG. 1 is a perspective view showing the insulation displacement connector according to the present invention before press-fitting connection of electric wires.
Figure 2A:
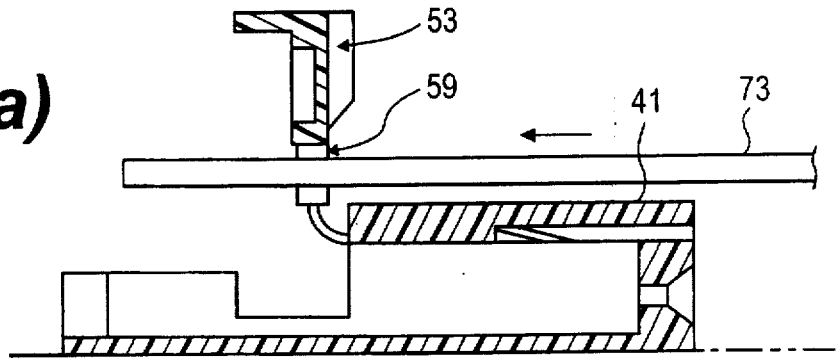
FIGS. 2(*a*) to 2(*d*) are-sectional views for explaining the electric wire assembling procedure in the insulation displacement connector according to the present invention.
Figure 2B:
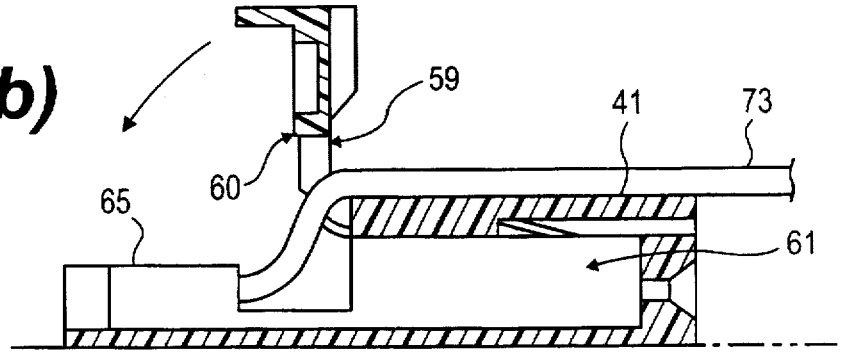
Figure 2C:
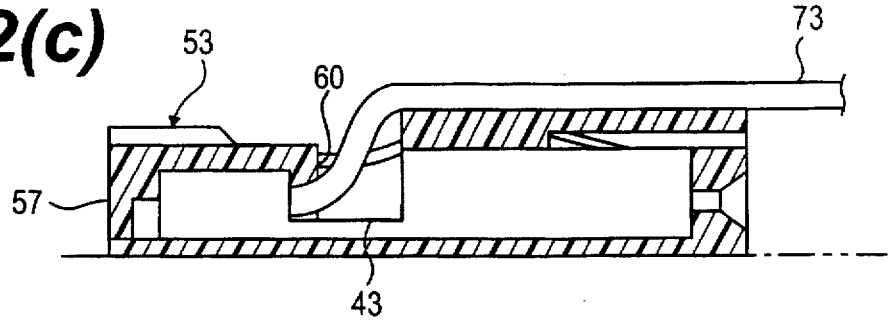
Figure 2D:
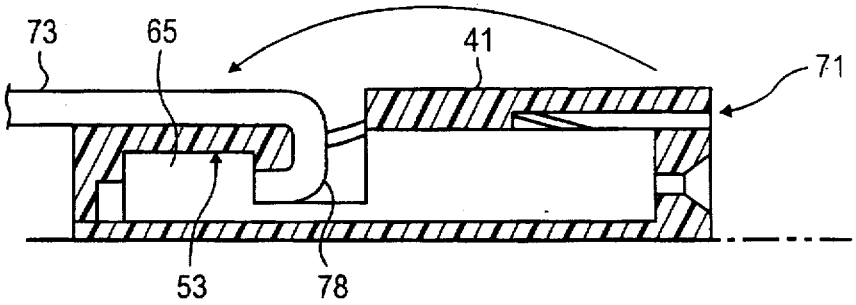

FIG. 1 is a perspective view showing a state of the insulation displacement connector according to the present invention before electric wires are press-fitted thereto. A terminal receiving chamber 43 is formed in a housing 41 so as to be opened at the front and rear portions of the housing 41. The terminal receiving chamber 43 may be formed singly in the housing 41, but a plurality of terminal receiving chambers 43 are arranged side by side in the housing 41 through barriers 45. Alternatively, a plurality of terminal receiving chambers 43 arranged side by side through barriers 45 may be provided on each of two, upper and lower stages separated by a horizontal partition 47. In this embodiment, description will be made as to an example in which a plurality of terminal receiving chambers 43 arranged side by side are provided in two, upper and lower stages, as shown in FIG. 1.

Upper and lower surface plates of a rear portion of the housing 41 are cut away so that rear portions of the terminal receiving chambers 43 are exposed to the outside. A plate-like openable/closable cover 53 is attached to each of the upper and lower surface opening portions 49 and 51 on the rear portion of the housing 41. Top ends of supporting arms 55 projected from each openable/closable cover 53 at its opposite sides are pivotally supported on opposite side walls of the housing 41. Being rotated toward the housing 41, the openable/closable covers 53 close the upper and lower surface opening portions 49 and 51 of the housing 41, respectively. Closing plates 57 are provided on the respective openable/closable covers 53 on the side opposite to the supporting arms 55 so that the closing plates 57 may close the rear portion openings of the terminal receiving chambers 43 when the openable/closable covers 53 are made to close the upper and lower surface opening portions 49 and 51.

Further, since the openable/closable cover 53 is attached to the housing 41 through the supporting arms 55 projected from the opposite ends of the openable/closable cover 53, a feed through space 59 feedable in the front and rear direction of the housing 41 is formed between the supporting arms 55 in an opened state (a state shown in FIG. 1). Therefore, when the housing 41 is closed with the openable/closable cover 53, the terminal receiving chambers 43 are partly exposed to the outside through the feed through space 59.

A press-fitting terminal 61 is mounted in each of the terminal receiving chambers 43. A press-fitting connection portion 65 having a pair of slit-like press-fitting blades 63 is formed on a rear end of the press-fitting terminal 61. Further, in the press-fitting terminal 61 to be used in this press-fitting connector, it is not necessary to provide any pressing portion for holding the electric wire behind the press-fitting blades 63.

Figure 3:
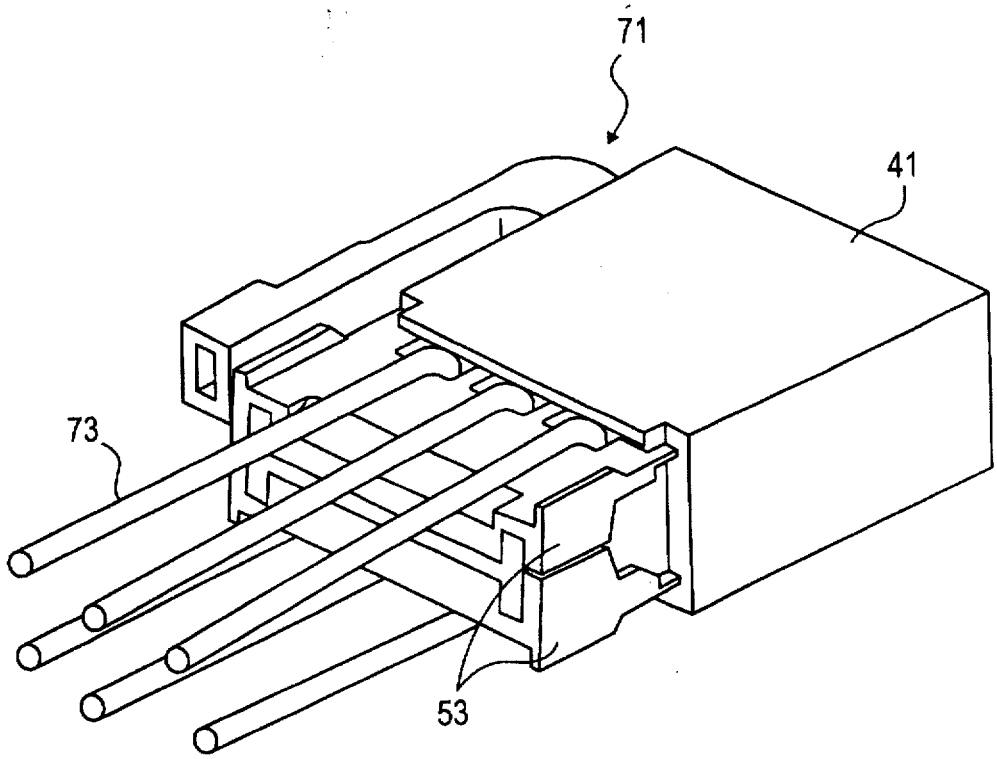
FIG. 3 is a perspective view showing the insulation displacement connector according to the present invention after press-fitting connection of electric wires.
Figure 4:
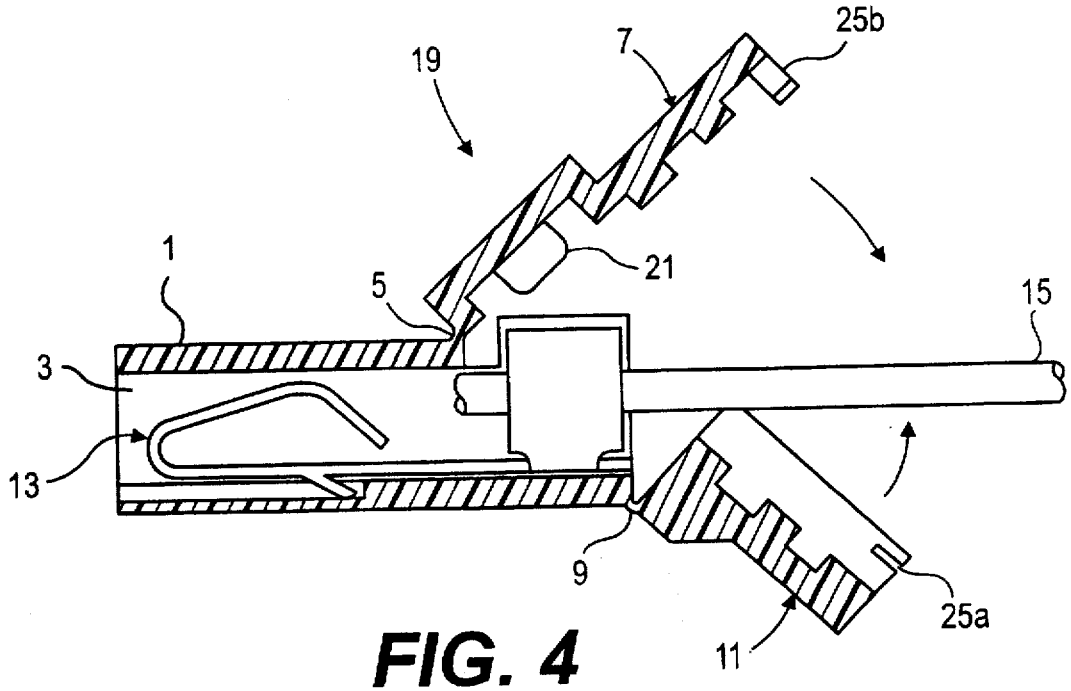
FIG. 4 PRIOR ART
FIG. 4 is a sectional view showing a conventional press-fitting connector in a state before press-fitting connection of electric wires.
Figure 5:
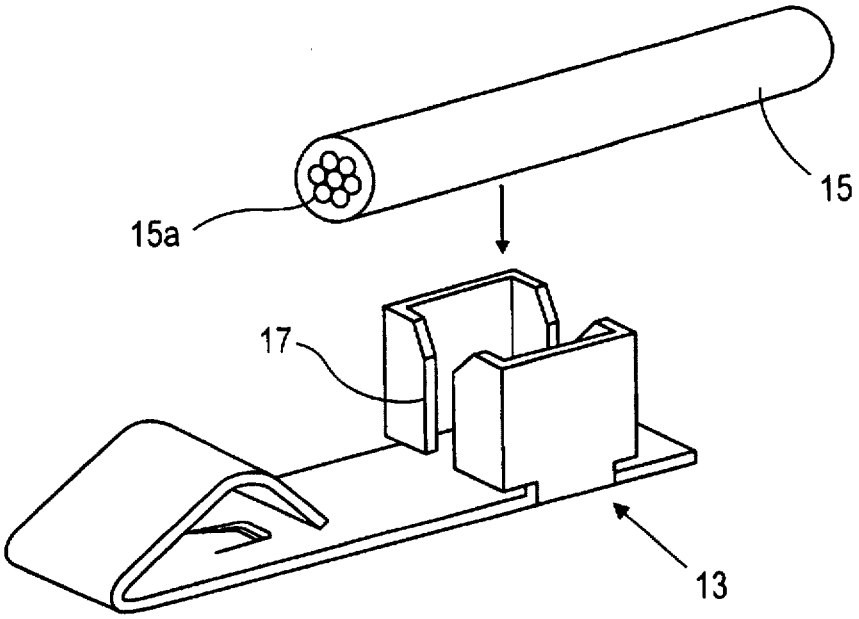
FIG. 5 PRIOR ART
FIG. 5 is a perspective view showing a press-fitting terminal to be used in the conventional press-fitting connector.
Figure 6:
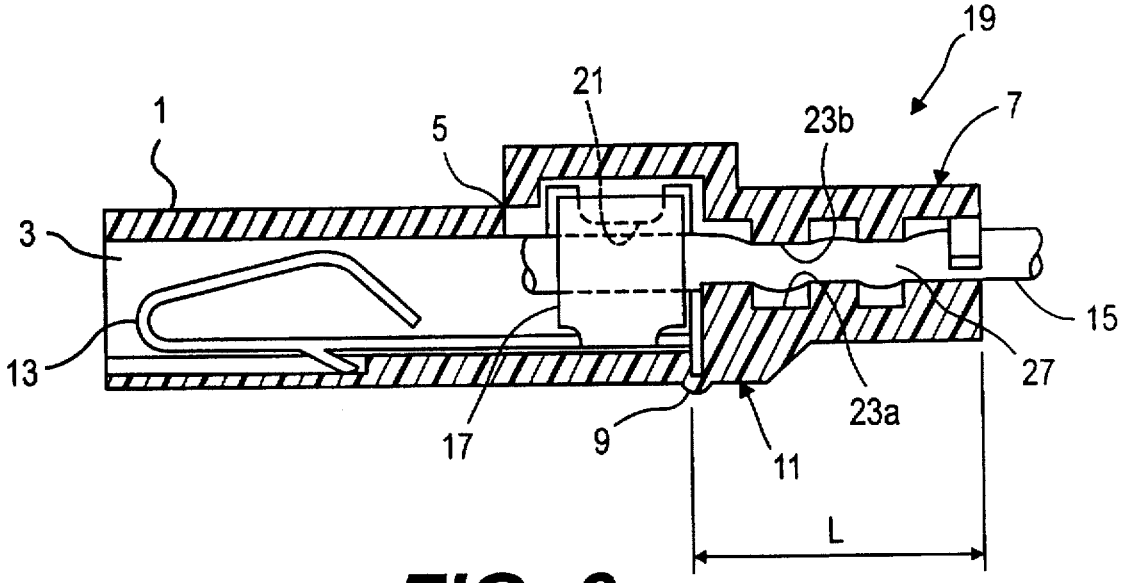
FIG. 6 PRIOR ART
FIG. 6 is a sectional view showing the conventional press-fitting connector in a state after press-fitting connection of electric wires.
Figure 7:
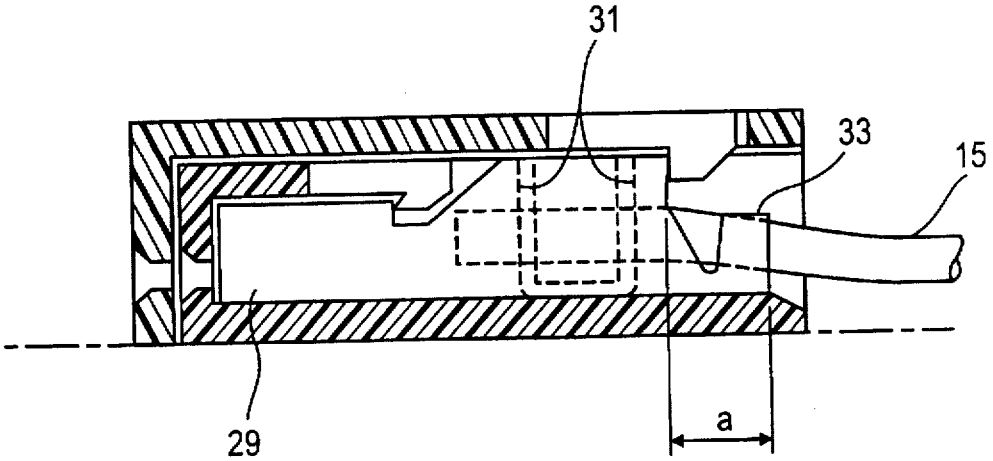
FIG. 7 PRIOR ART
FIG. 7 is a sectional view showing the conventional press-fitting connector in which a press-fitting terminal having a pressing portion is provided.

Description will now be made as to the electric wire assembling procedure in the thus configured insulation displacement connector 71. FIG. 2 depicts the electric wire assembling procedure in the insulation displacement connector according to the present invention and FIG. 3 is a perspective view depicts the insulation displacement connector according to the present invention after press-fitting connection of the electric wire. In order to attach an electric wire 73, first the openable/closable covers 53 are opened. By opening each openable/closable cover 53, the feed through spaces 59 feedable in the front and rear direction of the housing 41 is formed between the supporting arms 55.

The electric wire 73 is inserted from the front side of the housing 41 into the feed through space 59 as shown in FIG. 2(*a*). A forward end of the electric wire 73 inserted through the feed through space 59 is located above the press-fitting blades 63. Next, the forward end of the electric wire 73 is pressed into the press-fitting portion 65 by means of a pressing zig (not shown) as shown in FIG. 2(*b*). As a result, the conductor of the electric wire 73 is made conductive to the press-fitting terminal 61 through the press-fitting blades 63.

Therefore, the upper and lower surface opening portions 49 and 51 of the housing 41 are closed with the openable/closable covers 53 as shown in FIG. 2(*c*). Lock projections 75 (FIG. 1) of the openable/closable covers 53 are locked into lock grooves 77 formed in the side surfaces of the housing 41 so that the upper and lower surface opening portions 49 and 51 are closed and locked.

In this state, the closing plates 57 of the openable/closable covers 53 close the rear end surface of the housing 41, that is, the rear end openings of the terminal receiving chambers 43. Next, the base end side of the electric wire 73 positioned on the front side of the housing 41 is folded rearwardly of the housing 41 as shown in FIG. 2(*d*). Thus, all the electric wires 73 are bent at the contact portion where the electric wires 73 contact with the openable/closable covers 53 so as to be in the state as shown in FIG. 3 thereby completing the assembling of the insulation displacement connector. In the thus assembled insulation displacement connector 71, the electric wires 73 with their forward ends pressed in the press-fitting portions 65 are led out through the feed through spaces 59 of the openable/closable covers 53 and the base end sides of the electric wires 73 are folded back by 180° over the connector bend support surface 60 so that the electric wires 73 are U-like bent at the contact portions with the openable/closable covers 53. As a result, the external tensile strength exerted on the base end sides of the electric wires 73 is absorbed in the U-like bent portion 77 (FIG. 2(*d*)) and it does not act on the press-fitting portions 65. That is, the electric wires 73 are held against the external tensile force at their bent portions 78. As a result, the insulation displacement connector 71 has a high tensile strength against the backward tensile force exerted onto the electric wire 73.

According to the foregoing insulation displacement connector 71, the upper and lower surface opening portions 49 and 51 are formed in the rear portion of the housing 41, the openable/closable covers 53 are attached to the upper and lower surface opening portions 49 and-51, and the feed through spaces 59 through which the electric wires 73 can be fed from the front side of the housing 41 are formed in the openable/closable covers 53. Therefore, after the electric wires 73 have been pressed into the press-fitting terminals 61, the openable/closable covers 53 are closed and the electric wires 73 are bent by 180° over the connector bend support surface 60 so that the U-like bent portions 78 can be formed in the electric wires 73 respectively. As a result, the electric wires 73 can be firmly held without providing any conventional electric wire holding members or the like which project from the rear end of the housing 41, and the electric wire holding force of the insulation displacement connector can be increased in spite of reduced length.

Further, since it is not necessary to provide any pressing portion for holding the electric wires on the rear end of the insulation displacement connector 61, the whole length of the press-fitting terminals and the insulation displacement connector is not increased.

Moreover, since it is not necessary to provide any special electric wire holding structure such as an electric wire holding member, a pressing portion, or the like, the producing cost of the insulation displacement connector can be reduced.

Although description has been made above about an example in which the electric wires 73 are pressed into the press-fitting blades 63 with the jig in the foregoing embodiment, the insulation displacement connector according to the present invention may be configured such that pressing projections are provided on each of the openable/closable covers 53 so that by closing the openable/closable covers 53, the electric wires 73 are pressed into the press-fitting blades 63 by means of the pressing projections without performing the pressing by means of a zig.

In such a configuration, it is possible to reduce the steps of the assembling work of the insulation displacement connector, and the assembling of the insulation displacement connector can be performed in a short time because the pressing-in of the electric wires 73 can be completed simultaneously with closing of the openable/closable covers 53.

As described above in detail, in the insulation displacement connector according to the present invention, the opening portions are formed in the housing, the openable/closable covers are attached to the opening portions, and the feed through spaces through which the electric wires can be fed from the front side of the housing are formed in the openable/closable covers respectively. Therefore, the openable/closable covers are closed after the electric wires have been pressed into the press-fitting terminals, and the electric wires are bent by 180° over the connector bend support surface 60 so that the U-like bent portions can be formed in the electric wires respectively. As a result, the electric wires can be firmly held without providing any electric wire holding member or the like which project from the rear end of the housing, and the electric wire holding force of the insulation displacement connector can be increased in spite of its reduced whole length. Further, since it is not necessary to provide any special electric wire holding structure such as an electric wire holding member, a pressing portion, or the like, the producing cost of the insulation displacement connector can be reduced correspondingly.

What is claimed is:

1. An insulation displacement connector comprising:

a housing having terminal receiving chambers and an opening portion to expose said terminal receiving chambers to the outside; and a cover pivotably supported on said housing, the cover being rotatable toward and away from said housing, to close and open said terminal receiving chambers, the terminal receiving chambers for receiving terminal ends of the electrical conductors to form secure electrical connections, the cover further being rotatable into an open state to feed the terminal ends of the electrical conductors from a front mating end of said housing towards said terminal receiving chambers through a feed through space formed in said cover, wherein when said cover is closed, the electrical conductors are adapted to be bent rearwardly around a forwardly facing conductor bend support surface formed in the cover to form U-shaped bent portions near the forwardly facing conductor bend support surface to distribute external tensile force exerted on the conductors to prevent damage thereto.

2. The insulation displacement connector according to claim 1, wherein a press-fitting terminal having a press-fitting blade is mounted in each terminal receiving chamber.

3. The insulation displacement connector according to claim 1, wherein said cover has a pair of supporting arms singularly projecting from opposite ends thereof and pivotably supported at top ends thereof on said housing wherein the feed through space is formed between said pair of supporting arms.

4. The insulation displacement connector according to claim 1, wherein said terminal receiving chambers are arranged side by side through barriers.

5. The insulation displacement connector according to claim 4, wherein said terminal receiving chambers arranged side by side are provided on upper and lower stages separated by a horizontal partition, and a pair of said covers are pivotably supported on said housing respectively corresponding to said terminal receiving chambers on the upper and lower stages.

6. The insulation displacement connector according to claim 3, wherein said terminal receiving chambers are arranged side by side through barriers.

7. The insulation displacement connector according to claim 6, wherein said terminal receiving chambers arranged side by side are provided on upper and lower stages separated by a horizontal partition, and a pair of said covers are pivotably supported on said housing respectively corresponding to said terminal receiving chambers on the upper and lower stages.

8. The insulation displacement connector according to claim 1, wherein said cover has a pressing projection which presses an electric wire by closing said cover.

9. The connector according to claim 8, wherein the pressing projection interacts with the terminal receiving chambers, and bending the conductor on top of the cover securely holds the conductor without the need for additional crimping.

10. An insulation displacement connector for receiving and electrically securing electrical conductors having U-shaped portions, comprising:

a housing having terminal receiving chambers, said chambers including press fitting conductor blades;

said chambers for receiving terminal ends of conductors; and a cover pivotably supported on said housing to close said terminal receiving chambers when said cover is rotated toward said housing and to press fit each of the conductors in respective chambers to make electrical contact with the press fitting blades to form secure electrical connections, said connector further including a forwardly facing conductor bend support surface and a conductor feed through space;

wherein terminal ends of the electrical conductors are adapted to be fed through said feed through space into said terminal receiving chambers from a front mating end of said housing, when said cover is open, wherein when said cover is closed, the electrical conductors are adapted to be bent rearwardly around the forwardly facing conductor bend support surface to form U-shaped bent portions near the forwardly facing conductor bend support surface to distribute external tensile force exerted on the conductors to prevent damage thereto.

11. The insulation displacement connector according to claim 10, wherein a press-fitting terminal having a press-fitting blade is mounted in said terminal receiving chamber.

12. The insulation displacement connector according to claim 10, wherein said cover has a pair of supporting arms singularly projecting from opposite ends thereof and pivotably supported at top ends thereof on said housing wherein the feed through space is formed between said pair of supporting arms.

13. The insulation displacement connector according to claim 10, wherein said terminal receiving chambers are arranged side by side through barriers.

14. The insulation displacement connector according to claim 13, wherein said terminal receiving chambers arranged side by side are provided on upper and lower stages separated by a horizontal partition, and a pair of said covers are pivotably supported on said housing, respectively, corresponding to said terminal receiving chambers on the upper and lower stages.

15. The insulation displacement connector according to claim 12, wherein said terminal receiving chambers are arranged side by side through barriers.

16. The insulation displacement connector according to claim 15, wherein said terminal receiving chambers arranged side by side are provided on upper and lower stages separated by a horizontal partition, and a pair of said covers are pivotably supported on said housing, respectively, corresponding to said terminal receiving chambers on the upper and lower stages.

17. The insulation displacement connector according to claim 10, wherein said cover has a pressing projection which presses an electric wire by closing said cover.

18. The connector according to claim 17, wherein the interaction of the pressing projection, the terminal receiving chambers, and bending the conductor on top of the cover securely holds the conductor without the need for additional crimping.

* * * * *